United States Patent [19]

Hehn

[11] Patent Number: 4,760,416

[45] Date of Patent: Jul. 26, 1988

[54] WET PROCESSING ARRANGEMENT FOR PHOTOSENSITIVE ARTICLES

[75] Inventor: Wilfried Hehn, Munich, Fed. Rep. of Germany

[73] Assignee: Agfa-Gevaert Aktiengesellschaft, Leverkusen, Fed. Rep. of Germany

[21] Appl. No.: 913,949

[22] Filed: Oct. 1, 1986

[30] Foreign Application Priority Data

Oct. 16, 1985 [DE] Fed. Rep. of Germany ..... 3536863

[51] Int. Cl.[4] ..... G03D 3/06; G03D 3/08; B65H 20/02

[52] U.S. Cl. ..... 354/320; 354/324; 226/189; 226/190; 226/194

[58] Field of Search ..... 354/316, 320, 321, 322, 354/324, 328; 134/64 P, 122 P; 226/189, 190, 194

[56] References Cited

U.S. PATENT DOCUMENTS

| | | | |
|---|---|---|---|
| 3,435,749 | 4/1969 | Cauwe et al. | 226/189 |
| 3,532,048 | 10/1970 | Hope et al. | 354/320 |
| 4,312,585 | 1/1982 | Otsu et al. | 354/221 |

FOREIGN PATENT DOCUMENTS

| | | | |
|---|---|---|---|
| 56-125739A | 10/1981 | Japan | 354/324 |

*Primary Examiner*—A. A. Mathews
*Attorney, Agent, or Firm*—Peter K. Kontler

[57] ABSTRACT

A wet processing arrangement for photosensitive articles has a container for a processing bath. A rack is mountable in the container and includes a set of rollers which define nips for advancing photosensitive articles through the bath. A drive for the rollers is disposed inside the container. Means is provided to eliminate air bubbles which tend to form beneath the nips of the rollers as the rack is immersed in the bath.

32 Claims, 7 Drawing Sheets

WET PROCESSING ARRANGEMENT FOR PHOTOSENSITIVE ARTICLES

BACKGROUND OF THE INVENTION

The invention relates generally to the processing of photosensitive articles, e.g., photographic sheets.

More particularly, the invention relates to an arrangement for wet processing photosensitive articles.

A conventional arrangement for developing photosensitive articles includes a container which accommodates a processing bath. A rack is removably mounted in the container and comprises several driven rollers which are at least partially immersed in the bath. Each roller defines a nip with at least one other roller and cooperates with such other roller to convey photosensitive articles through the bath. The axes of rotation of the various pairs of cooperating rollers define respective planes, and at least some of these planes are inclined to the horizontal at an angle of 45° or less.

Such an arrangement is known, for instance, from the West German Offenlegungsschrift No. 25 14 594. In this arrangement, sets of three rollers each are disposed one above the other. The rollers of each set are resiliently urged towards one another, and the middle roller functions to transport photosensitive articles downwards as well as upwards.

In the developing arrangements of this type, streaks extending in the direction of transport frequently appear on the developed articles for an indeterminate period of time following immersion of the rack in the bath. These streaks are an indication that development was not uniform across the widths of the articles.

Exhaustive research has now shown that nonuniform development across the width of a photographic material is related to insertion of the rack in the bath. The rack is inserted in the bath by positioning the rack so that the roller axes are parallel to the surface of the bath and then lowering the rack straight into the bath. As the rollers enter the bath, air is trapped in the space defined by the lower surfaces of the rollers, the inner surfaces of the rack and the surface of the bath. Since the liquid pressure increases as the rollers descend through the bath, the air is only partially forced along the undersides and to the lateral faces of the rollers where it can escape. Especially when the rollers are long, very nearly parallel and define very tight nips, small air bubbles tend to remain at various locations along the rollers and subsequently combine to form larger air pockets. When the development process starts, a photosensitive article is conveyed through the nip between cooperating rollers and passes through the air pocket or pockets disposed below such nip. The portions of the article which penetrate the air pockets are thus not wetted by active processing fluid for a certain period of time. On the other hand, the portions of the article next to the air pockets continue to be wetted by the fluid and, particularly at the beginning of the development process, undergo relatively intense development. Although the article is later wetted uniformly, the difference in the intensity of development is not equalized. On negatives, the air pockets manifest themselves as bright streaks. Inasmuch as the air pockets are pushed back-and-forth along the roller axes during the development process, the positions of the streaks may vary across the width of the article.

Due to oxidation of the developer, entrainment by the articles undergoing development and slow lateral movement followed by escape, the quantity of trapped air decreases with increasing developing time. Finally, after periods of up to an hour, the air pockets are dissipated.

OBJECTS AND SUMMARY OF THE INVENTION

It is an object of the invention to provide a wet processing arrangement which employs a roller rack but is designed in such a manner that relatively uniform processing across the width of a photosensitive article may be achieved at all times, even immediately following insertion of the roller rack in the processing bath.

Another object of the invention is to provide a method which allows a roller rack to be introduced into a processing bath with little, if any, air entrapment.

The preceding objects, as well as others which will become apparent as the description proceeds, are achieved by the invention.

One aspect of the invention resides in an arrangement for wet processing photosensitive articles, particularly for developing photographic materials. The arrangement comprises a container for a processing bath, and a rack mountable in the container and including a pair of cooperating rollers defining a nip for guiding photosensitive articles. The arrangement further comprises means for eliminating air bubbles which tend to form in the region of the nip upon entry of the rollers into a bath accommodated by the container.

The rollers are arranged to be at least partially immersed in the bath when the rack is properly mounted in the container, and the plane defined by the axes of rotation of the rollers may make an angle of 45° or less with the horizontal in such position of the rack. Drive means may be provided for the rollers in order to enable the latter to advance photosensitive articles through the bath.

The eliminating means may be designed to avoid the formation of air bubbles as the rack is introduced into the bath or to allow any air bubbles which form to be dissipated immediately after insertion of the rack in the bath. As a result, photosensitive articles undergoing processing may be prevented from coming into contact with trapped air bubbles so that uniform processing may be obtained from the outset.

The eliminating means may take various forms. According to one embodiment of the invention, the eliminating means comprises guide means which requires the rack to pivot in such a manner during introduction into the bath that air has the opportunity to escape from the region of the nip as the rollers enter the bath.

Pivoting of the rack may take place about an axis which substantially parallels the rotational axes of the rollers or which extends transverse to the axes of rotation.

In accordance with another embodiment, the rollers are temporarily moved away from one another while in the processing bath so that trapped air becomes free to escape upwards.

According to a further embodiment of the invention, trapped air is avoided by inserting the cooperating rollers in the bath separately one after the other.

In accordance with an additional embodiment of the invention, trapped air is eliminated by creating a current of fluid in the region of the nip so as to displace trapped air laterally. Preferably, the current is caused to flow longitudinally of the rollers.

The novel features which are considered as characteristic of the invention are set forth in particular in the appended claims. The improved wet processing arrangement itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
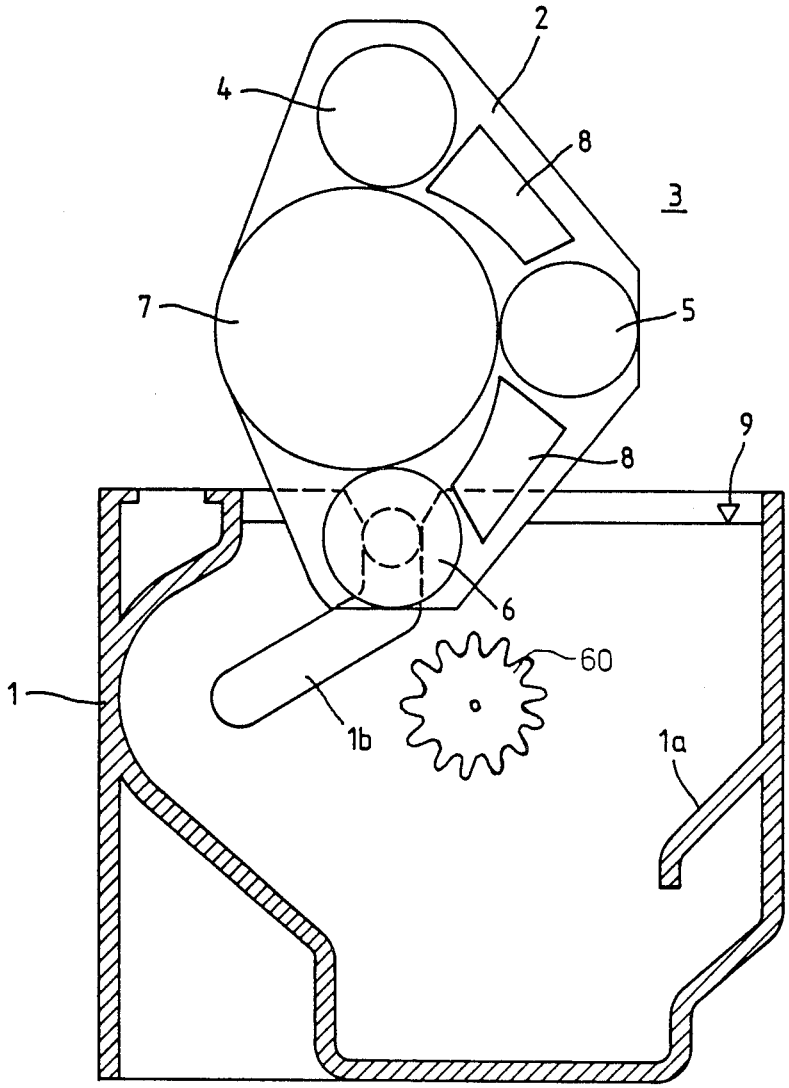
FIG. 1 is a sectional side view of one embodiment of the wet processing arrangement according to the invention showing the rack preparatory to insertion in the container.
Figure 2:
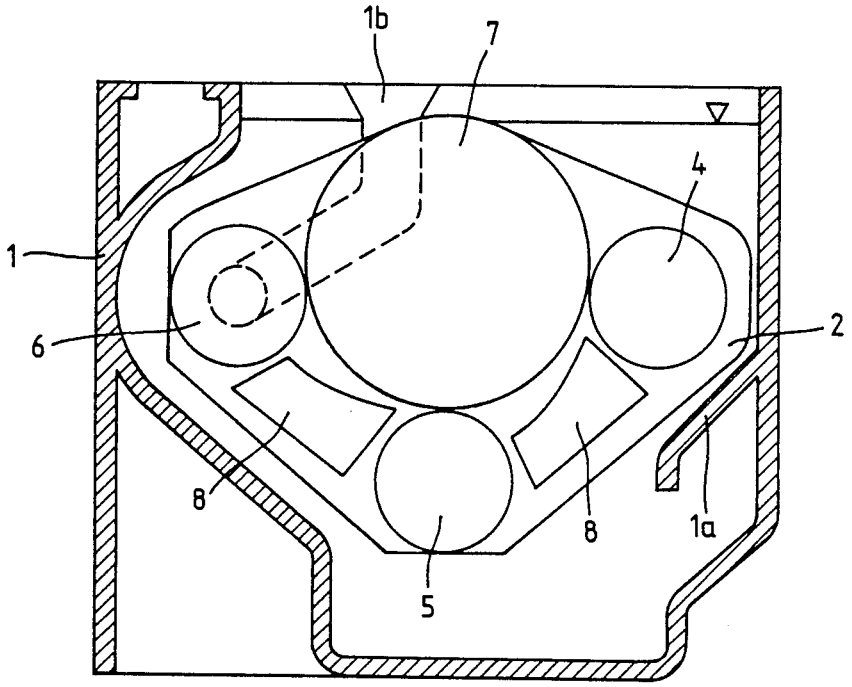
FIG. 2 shows the arrangement of FIG. 1 with the rack properly mounted in the container.

Referring to FIGS. 1 and 2, the reference numeral 1 identifies a container for accommodating a processing bath of a photographic developing apparatus, particularly an apparatus for developing photographic sheets. A rack 3 is mountable in the container 1 and includes a pair of spaced plates 2 which carry a group of rollers 4, 5, 6, 7. Only one of the plates 2 is shown in FIGS. 1 and 2 for the sake of clarity. The plates 2 are joined to one another by connecting elements 8 so that the rack 3 constitutes an essentially rigid body.

The rollers 4, 5, 6 are arranged about the roller 7 in such a manner that the rollers 4, 5, as well as the rollers 5, 6, are offset from one another by approximately 90°. Each of the rollers 4, 5, 6 is biased against the central roller 7 by one or more non-illustrated resilient elements so that the rollers 4, 5, 6 are disposed adjacent to, and define respective tight nips with, the roller 7. A drive 60 is located inside the container 1, at least for the roller 7, and may, for instance, comprise a gear wheel transmission.

The connecting elements 8 function not only to join the plates 2 to one another but also to guide photosensitive articles passing through the rack 3 into the nips of the rollers 4,7 and 5,7.

The reference numeral 9 indicates the level of processing fluid in the container 1 when the wet processing arrangement of FIGS. 1 and 2 is ready for operation. The interior of the container 1 has an outline which conforms to that of the rack 3. Furthermore, one or more supports 1*a* for the plates 2 are provided inside the container 1 so that, when the rack 3 is mounted in readiness for operation, it assumes the position illustrated in FIG. 2. In this position, the plane defined by the axes of rotation of the cooperating rollers 6, 7, as well as the plane defined by the axes of rotation of the cooperating rollers 4, 7, make an angle of at most 45° with the horizontal.

The container 1 has a pair of opposed side walls, and a guide groove 1*b* is formed in each side wall. Each of the guide grooves 1*b* has a funnel-like open end which is located at the top of the container 1 and converges in a downward direction. The funnel-like open end merges into a short vertical section of the respective groove 1*b* which, in turn, merges into a longer inclined section of the groove 1*b*. The inclined section of each groove 1*b* terminates in a seat or bearing for a pivot which may be constituted by a stub of the roller 6 or a pin secured to the respective plate 2 of the rack 3 and extending substantially parallel to the axes of rotation of the rollers 4–7. The seats or bearings are designed to rotatably or pivotally support the pivots.

The operation of the wet processing arrangement of FIGS. 1 and 2 may be readily understood. In order to insert the rack 3 in the container 1 accommodating the processing bath, the rack 3 is oriented such that it is rotated counterclockwise from the operative position of FIG. 2. The rack 3 should be rotated from the operative position to such an extent that the plane defined by the axes of rotation of the cooperating rollers 6, 7 makes an angle of at least 60° with the horizontal. FIG. 1 shows the rack 3 preparatory to insertion in the container 1. In the showing of FIG. 1, the rack 3 has been rotated counterclockwise from the operative position of FIG. 2 by about 90°, that is, the plane defined by the axes of rotation of the opposed rollers 4,6 is approximately perpendicular to the horizontal. With the rack 3 in the position of FIG. 1, the stubs of the shaft 6 or the pivot pins on the plates 2 are introduced into the funnel-like open ends of the guide grooves 1*b*. The stubs or pins are then moved straight down through the vertical sections of the grooves 1*b*, and finally down and to the left along the inclined sections until the stubs or pins are disposed in the seats or bearings defined by the lower ends of the grooves 1*b*. The nip defined by the rollers 6,7 thus enters the processing bath while these two rollers are situated one above the other on a line which is generally normal to the surface of the bath. Accordingly, no air can be trapped in the space defined by the rollers 6, 7 adjacent to the lower sides thereof, and hence adjacent to the lower portion of the respective nip, because the processing fluid pushes any air present in this space to both sides along the surface of the roller 7.

Insertion of the rack 3 in the container 1 is completed by rotating or pivoting the rack 3 clockwise to the operative position of FIG. 2. This clockwise rotation, which takes place about an axis substantially paralleling the rotational axes of the rollers 4–7, may be initiated even before the stubs of the roller 6 or the pivots on the plates 2 assume the final positions illustrated in FIG. 2. Although small air bubbles may be trapped between the rollers 5, 7 prior to pivoting of the rack 3 into the operative position of FIG. 2, the pivotal motion of the rack 3 gives these air bubbles an opportunity to ascend. Air bubbles which may remain in the gap between the rollers 4, 7 have a much smaller influence on the processing results because a photosensitive article entering this gap has already traveled a relatively great distance through processing fluid free of air bubbles. Hence, the differences in the time for which the processing fluid acts on different portions of the article are so small as to play hardly any role in the processing results.

The guide grooves 1b may be considered to at least in part constitute a means for eliminating air bubbles which tend to be trapped by the rollers 6,7 as the latter are introduced into the processing bath.

Figure 3:
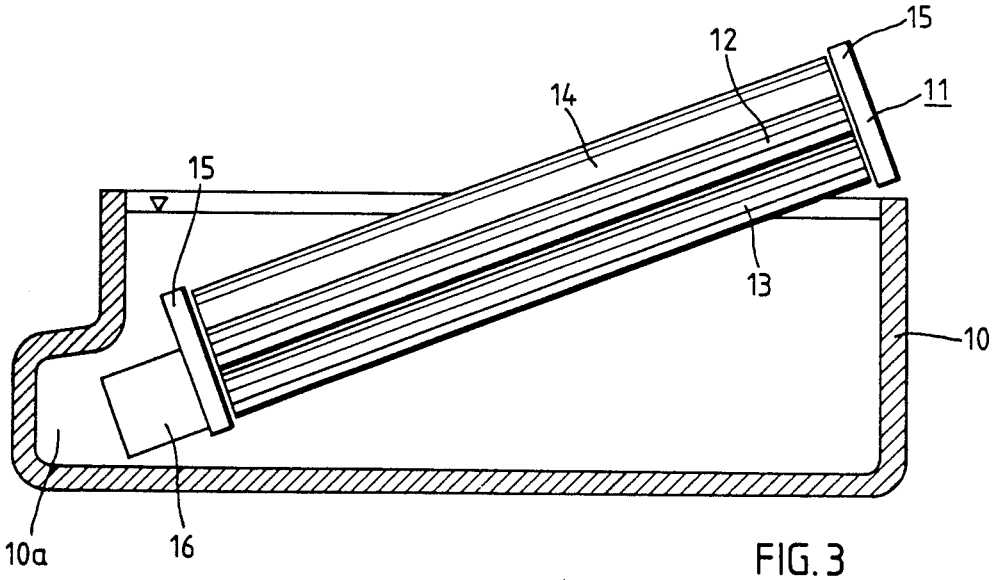
FIG. 3 is a sectional end view of another embodiment of the wet processing arrangement in accordance with the invention showing the rack during insertion in the container.

FIG. 3 shows another embodiment of the wet processing arrangement according to the invention. The arrangement of FIG. 3 is similar to that of FIGS. 1 and 2 in that the rack undergoes pivoting during insertion in the container for the processing bath. However, while the rotational axes of the rollers in the rack of FIGS. 1 and 2 remain generally parallel to the horizontal as the rack is introduced into the container, the rotational axes of the rollers in the rack of FIG. 3 are inclined to the horizontal during insertion of the rack in the container.

In FIG. 3, the reference numeral 10 identifies a container for a processing bath. The container 10 corresponds to the container 1 of FIGS. 1 and 2 and is designed to receive a rack 11 corresponding to the rack 3. The rack 11 comprises a pair of spaced plates 15 which carry a set of rollers 12, 13, 14 defining a plurality of nips. At least one of the rollers 12, 13, 14 is driven.

The container 10 is formed with retaining means configurated as an undercut or recess 10a while the left-hand plate 15 of the rack 11, as viewed in FIG. 3, is provided with a projection 16 which fits in and is retained by the recess 10a. The distance between the plates 15 approximates the internal width (measured horizontally in FIG. 3) of the portion of the container 10 above the recess 10a. Accordingly, it is not possible to insert the rack 11 in the container 10 when the rack 11 is oriented such that the rollers 12–14 are horizontal. In order to introduce the rack 11 into the container 10, the rack 11 must be positioned with the projection 16 facing the recess 10a and inclined downwards. The axes of rotation of the rollers 12–14 are then inclined to the horizontal. The rack 11 is now shifted laterally to move the projection 16 into the recess 10a. Once the projection 16 is fully received by the recess 10a, the plate 15 remote from the projection 16 can be moved downwards along the adjacent wall of the container 10. During such movement, the rack 11 pivots in a plane which passes through the axis of rotation of one of the rollers 12–14 and is generally perpendicular to the horizontal. Tilting of the rack 11 during introduction into the processing bath allows sufficient time for any air present between the rollers 12–14 to escape by flowing upwards. Thus, no air bubbles are trapped in the regions of the nips defined by the rollers 12–14. In FIG. 3, the rollers 12–14 are assumed to define three nips.

The recess 10a may be considered to at least partially constitute a means for eliminating air bubbles which tend to form as the rack 11 is inserted in the processing bath of the container 10. The recess 10a may be replaced by a clamp designed to retain the projection 16.

Figure 4:
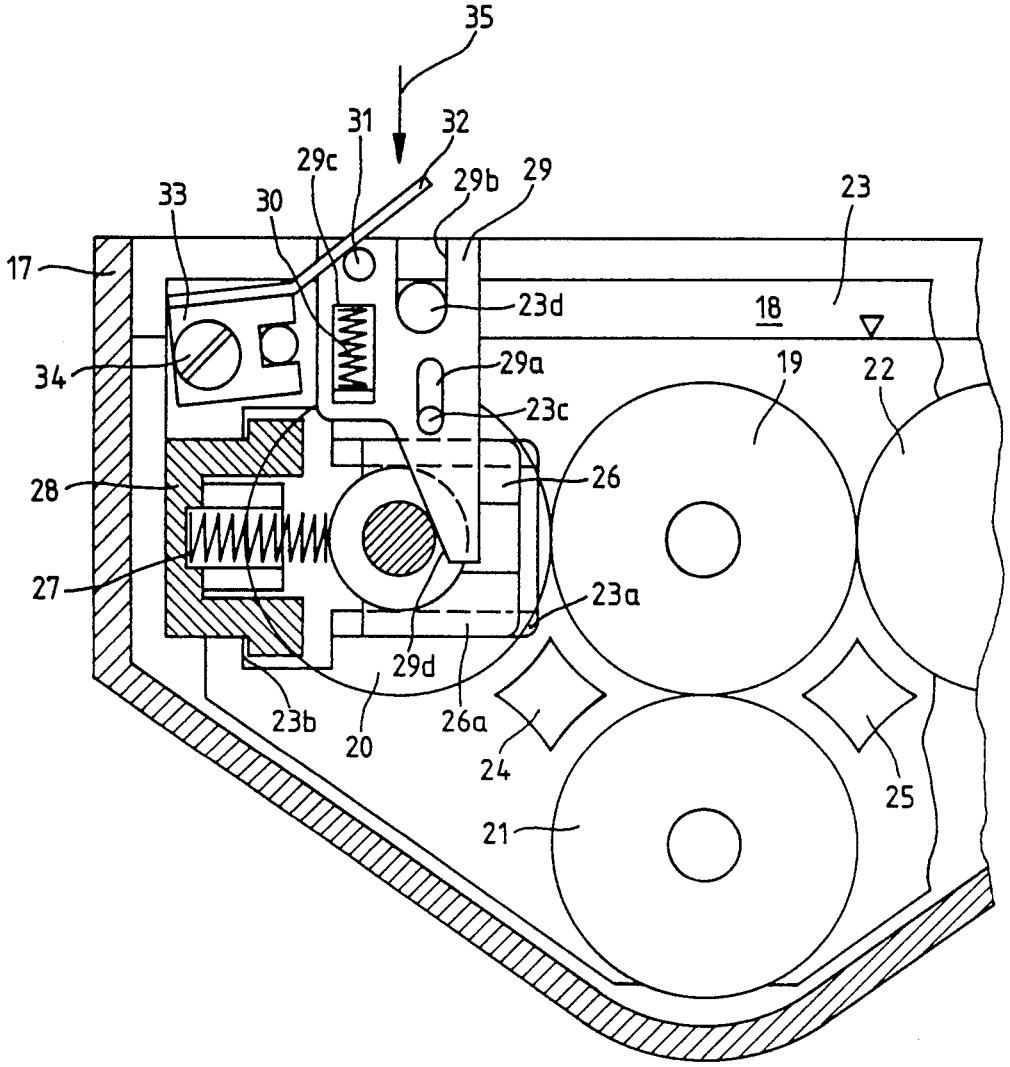
FIG. 4 is a fragmentary sectional side view of a further embodiment of the wet processing arrangement according to the invention.

FIG. 4 illustrates a further embodiment of the wet processing arrangement in accordance with the invention. The reference numeral 17 in FIG. 4 identifies a container for a processing bath. The container 17 is generally cubical but has longitudinally extending bottom walls which are sloped in order to reduce the volume of processing fluid. A rack 18 containing four rollers 19, 20, 21, 22 is mounted in the container 17. The roller 22, which is situated at the exit of the rack 18, is only partly visible in FIG. 4. The rollers 20, 21, 22 are spaced about, and define respective nips with, the roller 19. The central roller 19 is driven in conventional fashion whereas the rollers 20, 21, 22 cooperating with the roller 19 may be idler rollers which are caused to rotate due to frictional engagement therewith. The rollers 19–22 are journalled in spaced plates 23 which constitute part of the rack 18. For the sake of clarity, one of the plates 23 has been omitted from FIG. 4. In order to stabilize the rack 18, the plates 23 are joined to one another by connecting elements 24 and 25. The connecting elements 24, 25 serve not only to join the plates 23 to each other but also to guide the leading edge of a photo-sensitive article passing through the rack 18 into the next nip.

FIG. 4 illustrates in some detail the manner of mounting the roller 20 on the illustrated plate 23. The roller 20 is disposed in a bearing element 26 having dovetail-shaped guide portions 26a. The plate 23 has matching guide elements 23a, and the bearing element 26 is slidably mounted in the guide elements 23a via the guide portions 26a. The bearing element 26 is engaged by one end of a coil spring 27 consisting of corrosion-resistant steel wire. The other end of the spring 27 is received by a spring retainer 28 which engages in cutouts 23b provided in the plate 23. The spring 27 functions to hold the spring retainer 28 in position and also to urge the bearing element 26 towards the roller 19.

A similar mounting arrangement for the roller 20 is provided in the non-illustrated plate 23. Such mounting arrangements are likewise provided in the two plates 23 for each of the rollers 21, 22. Thus, each of the rollers 20–22 extends in parallelism with and is pressed against the central, driven roller 19 over the entire length of the respective roller 20–22.

Referring still to FIG. 4, the plate 23 is provided with a pin 23c and an arresting stud 23d. A slide 29 is mounted on the plate 23 for vertical movement and is formed with vertically extending slots 29a and 29b which respectively receive the pin 23c and stud 23d. The slide 29 further has a passage 29c. A coil spring 30 is disposed in the passage 29c, and the lower end of the coil spring 30 bears against the bottom of a passage in the plate 23 while the upper end of the coil spring 30 bears against the top of the passage 29c in the slide 29. The spring 30 urges the slide 29 to an uppermost position which is determined by abutment of the bottom of the slot 29b against the stud 23d.

The lower end of the slide 29 has a control edge 29d which is inclined at an angle of about 70° to the horizontal. The control edge 29d abuts a stub of the roller 20, and the inclination of the control edge 29d is selected in such a manner that, when the control edge 29d is pushed down, it moves the roller 20 away from the roller 19 against the force of the spring 27.

The slide 29 is further provided with an entraining pin 31 which is disposed in the path of a manually operable lever 32. The lever 32 is connected with an arresting element 33 which is pivotally mounted on a screw 34 threaded into the plate 23. The arresting element 33 functions to lock the plate 23 in operative position inside the container 17 by means of a non-illustrated hook.

The operation of the wet processing arrangement of FIG. 4 is as follows:

The rack 18 including the plates 23 and the rollers 19–22 is positioned above the container 17 in such a manner that the axes of rotation of the rollers 19–22 are essentially horizontal. The rack 18 is then lowered into the processing bath while maintaining this orientation so that it assumes the operative position of FIG. 4. When the rack 18 is in the operative position, an operator depresses the lever 32 as indicated by the arrow 35. This causes the non-illustrated hook on the arresting element 33 to be raised above a catch in the container 17. At the same time, the slide 29 is pushed down because the lever 32 presses down on the entraining pin 31. The slide 29 remains depressed for as long as the lever 32 is depressed. The downward movement of the slide 29 causes the control edge 29*d* to shift the roller 20 away from the central roller 19. Consequently, any air trapped below the nip defined by the rollers 19,20 can escape upwards. Upon release of the lever 32 by the operator, the spring 27 urges the roller 20 back into engagement with the roller 19 while the spring 30 forces the slide 29 upwards to its initial position.

No air can settle in the region of the nip defined by the rollers 19,21. On the other hand, while it is possible for air bubbles to be trapped below the nip defined by the rollers 19,22, a photosensitive article traveling through the processing bath in the container 17 reaches this region at such a late stage that, as a rule, the air bubbles have no noticeable adverse effect on processing. However, should such air bubbles be found to yield undesirable effects, a roller shifting mechanism similar to that employed for the roller 20 may be provided for the roller 22.

The shifting mechanism 29–32 for temporarily moving the roller 20 away from the roller 19 by hand may be designed without means such as the arresting element 33 for locking the rack 18 in position within the container 17. Furthermore, it is possible to depress the lever 32 as the rack 18 is being lowered into the container 17 rather than waiting until the rack 18 has assumed its operative position.

The shifting mechanism 29–32 may be considered to at least partially constitute a means for eliminating air bubbles which tend to be trapped by the rollers 19,20 as these are introduced into the processing bath.

Figure 5:
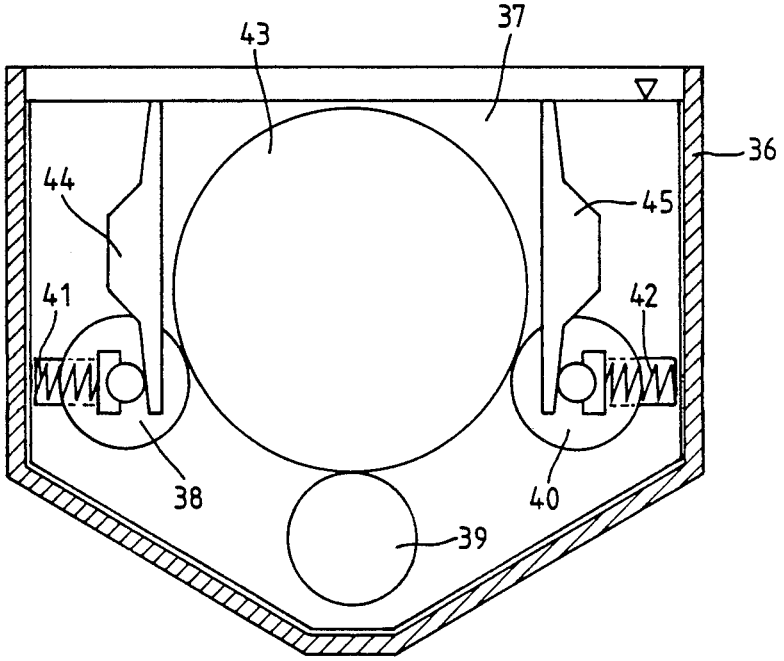
FIG. 5 is a sectional side view of an additional embodiment of the wet processing arrangement in accordance with the invention.

An additional embodiment of the wet processing arrangement according to the invention is shown in FIG. 5. The reference numeral 36 identifies a container for a processing bath. Similarly to the container 17 of FIG. 4, the container 36 is of generally cubical form but has sloping bottom walls to reduce the volume of processing fluid. A rack 37 including four rollers 38, 39, 40, 43 is mountable in the container 36. The rollers 38, 39, 40 are spaced about and define respective nips with the roller 43. The latter is driven, and the rollers 38, 40 are biased against the central roller 43 by springs 41, 42 while the roller 39 is biased against the roller 43 by a non-illustrated spring.

Spaced guides are mounted inside the container 36 on the end walls of the same and serve to direct the rack 37 along a predetermined path as this is inserted in the processing bath. These guides are provided with respective cams 44, 45 which extend along a segment of the path of the rack 37 and terminate close to the positions occupied by the rollers 38, 40 when the rack 37 assumes the operative position of FIG. 5. The guides have outwardly facing surfaces which are arranged to engage the stubs of the rollers 38, 40.

The operation of the wet processing arrangement of FIG. 5 is readily apparent. As lowering of the rack 37 into the container 36 begins, the stubs of the rollers 38, 40 come into contact with the outwardly facing surfaces of the guides. Upon further downward movement of the rack 37, the stubs of the rollers 38,40 engage the cams 44, 45 which cause the rollers 38, 40 to shift away from the central roller 43 by a distance sufficient to permit the escape of any air trapped beneath the nips defined by the roller pairs 38,43 and 40,43. This shifting takes place while the rack 37 is being lowered. The cams 44, 45 have a certain length as considered in the direction of movement of the rack 37 so that the rollers 38, 40 remain displaced from the roller 43 along a relatively long segment of the path of the rack 37. Once the stubs of the rollers 38, 40 have passed by the cams 44, 45, the springs 41, 42 urge the rollers 38, 40 back into engagement with the central roller 43. Inasmuch as the rollers 38, 40 are displaced from the roller 43 along at least part of the path of the respective nips through the processing fluid, no air bubbles can be present below the nips after the rollers 38, 40 have been moved back into engagement with the roller 43.

The cams 44, 45 constitute a means for shifting the rollers 38, 40 away from the roller 43, and such shifting means 44, 45 may be considered to at least partially constitute a means for eliminating air bubbles which tend to form in the regions of the nips defined by the roller pairs 38, 43 and 40, 43 upon immersion in the processing bath.

Figure 6:
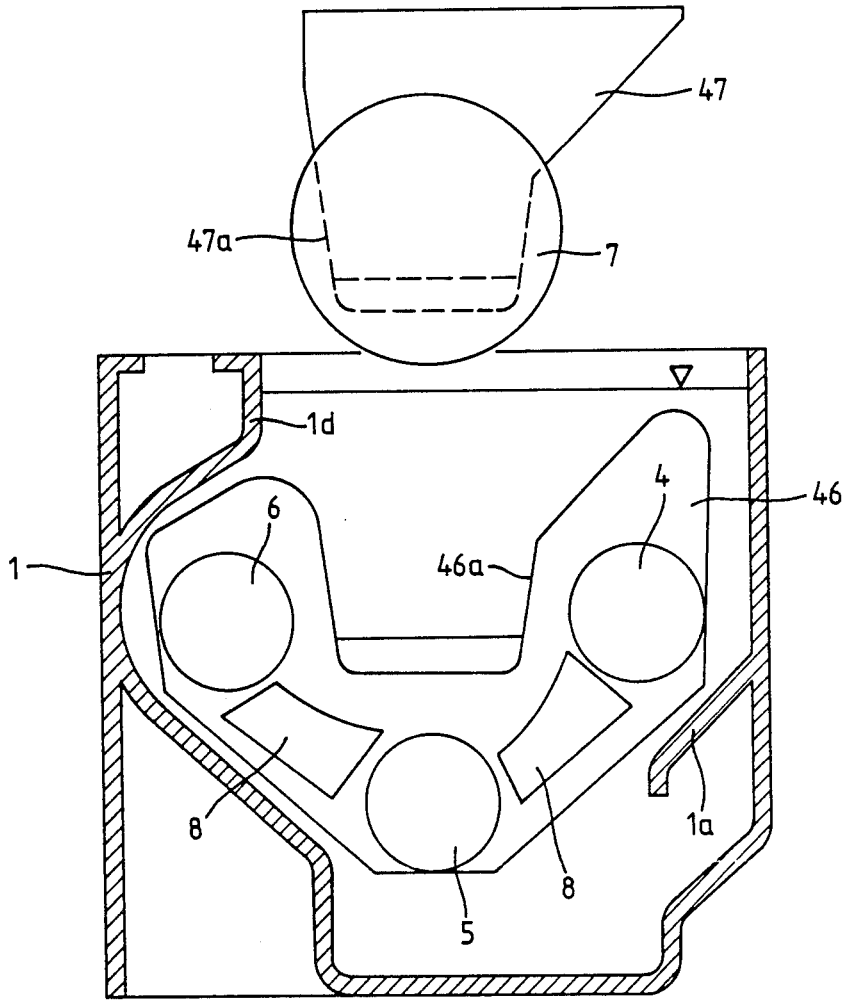
FIG. 6 is a sectional side view of yet another embodiment of the wet processing arrangement according to the invention showing the rack partially mounted in the container.
Figure 7:
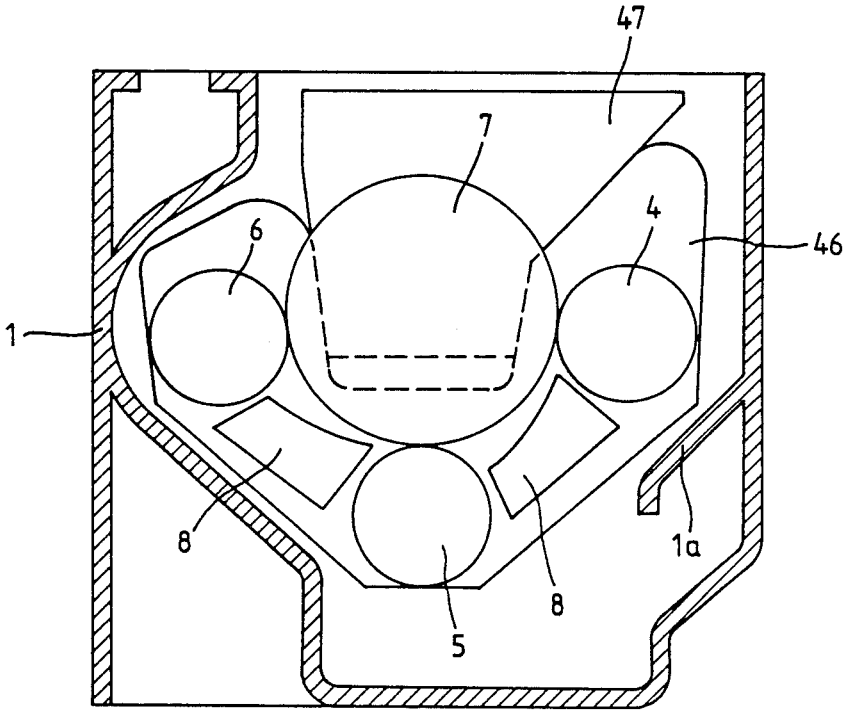
FIG. 7 shows the arrangement of FIG. 6 with the rack properly mounted in the container.

FIGS. 6 and 7 illustrate yet another embodiment of the wet processing arrangement in accordance with the invention. The geometry of the container for the processing bath, as well as the grouping of the rollers, are the same as in the wet processing arrangement of FIGS. 1 and 2. The elements of the wet processing arrangement of FIGS. 6 and 7 which correspond functionally to those of the arrangement of FIGS. 1 and 2 are identified by the same reference numerals.

The wet processing arrangement of FIGS. 6 and 7 differs from that of FIGS. 1 and 2 in that the rack is divided into a lower section 46 and an upper section 47 which are separable from one another as shown in FIG. 6. Each of the plates of the rack is divided into a lower part and an upper part, and the lower parts of the plates carry the rollers 4, 5, 6 while the upper parts of the plates carry the central roller 7. The rollers 4, 5, 6 and the lower parts of the plates belong to the lower rack section 46 whereas the roller 7 and the upper parts of the plates belong to the upper rack section 47.

The lower rack section 46 is formed with a trapezoidal cutout 46*a*, and the upper rack section 47 has a trapezoidal portion 47*a* designed to be received in the cutout 46*a*. The lower rack section 46 may, if necessary, be releasably secured to the upper rack section 47 via non-illustrated locking means once the trapezoidal portion 47*a* has been inserted in the cutout 46*a*.

The container 1 is provided with a protuberance 1*d* arranged in such a manner that the lower rack section 46 can be passed by the protuberance 1*d* and properly seated in the container 1 only when the lower rack section 46 is rotated from or inclined relative to the operative position of FIGS. 6 and 7. The inclination or rotation required to insert the lower rack section 46 in the container 1 is prevented by the protuberance 1*d* when the rack sections 46,47 mate with one another, i.e., it is impossible to introduce the assembled rack 46, 47 into the container 1.

The operation of the wet processing arrangement of FIGS. 6 and 7 is as follows:

It is assumed that the rack 46, 47 is outside of the container 1 and that the rack sections 46 and 47 are separated from one another. The lower rack section 46 containing the rollers 4, 5, 6 is oriented so that it is inclined with respect to the operative position of FIGS. 6 and 7. The lower rack section 46 is introduced into the container 1 in this orientation and rotated to its operative position. Inasmuch as the lower rack section 46 does not include directly abutting rollers, no air bubbles are trapped upon introduction of the lower rack section 46 into the processing bath. Once the lower rack section 46 is in its operative position, the upper rack section 47 with the central roller 7 is positioned above the container 1 in the manner shown in FIG. 6. The upper rack section 47 is now lowered to the operative position of FIG. 7 in which the trapezoidal portion 47*a* is received by the trapezoidal cutout 46*a*. Again, no air bubbles can be trapped during insertion of the upper rack section 47 into the processing bath. Thus, in the wet processing arrangement of FIGS. 6 and 7, air bubbles are unable to form because cooperating rollers are introduced into the processing bath sequentially rather than simultaneously.

The protuberance 1*d*, which represents a means for preventing insertion of the rack sections 46, 47 in the processing bath simultaneously, may be considered to at least partially constitute a means for eliminating air bubbles which tend to form in the regions of the nips defined by the roller pairs 6, 7 and 4, 7 upon introduction of the rack 46, 47 in the processing bath.

Figure 8:
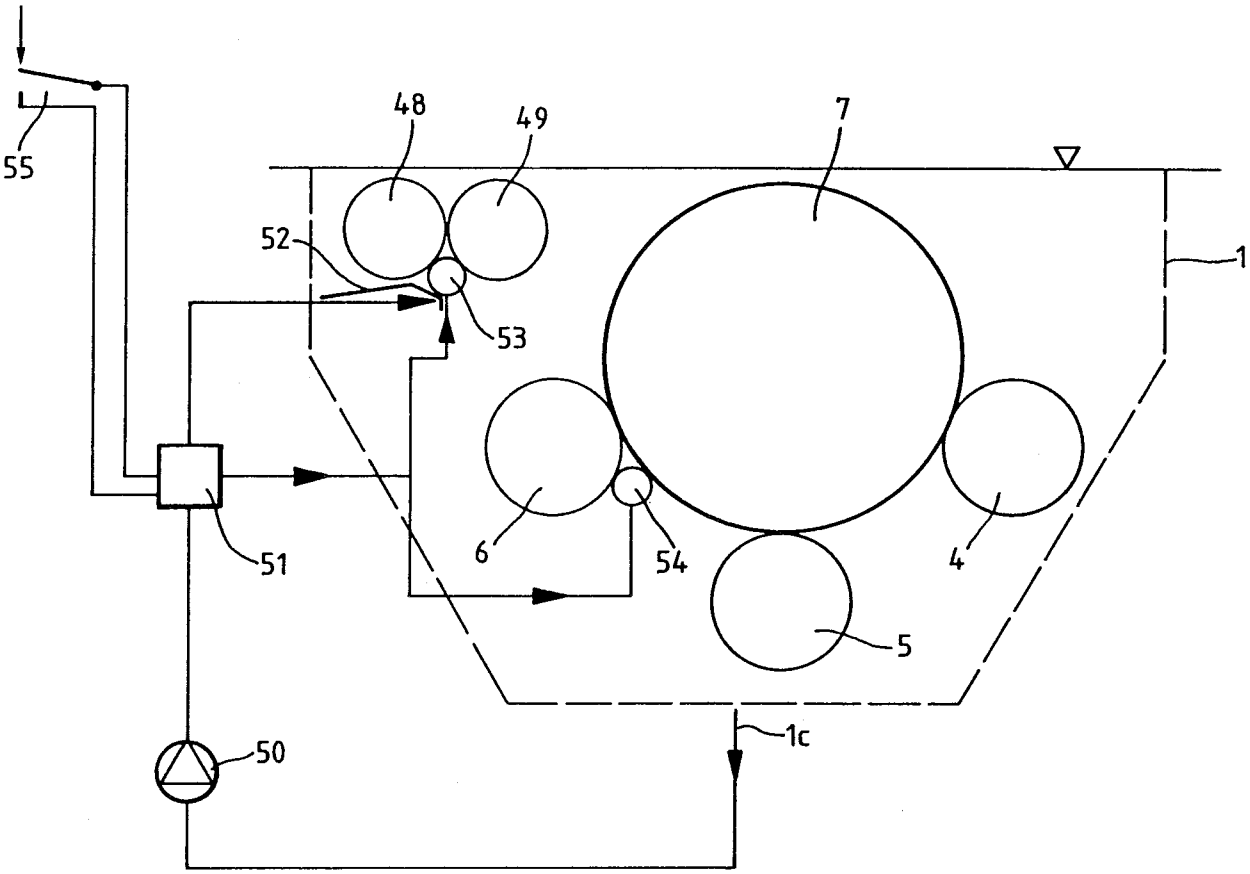
FIG. 8 is a schematic sectional side view of still a further embodiment of the wet processing arrangement in accordance with the invention.

FIG. 8 illustrates still a further embodiment of the wet processing arrangement according to the invention. The container for the processing bath is again identified by the reference numeral 1, and the container 1 is designed to accommodate a rack which, like that of FIGS. 1 and 2, comprises several rollers 4, 5, 6 distributed about a central roller 7. The positions and functions of the rollers 4–7 of FIG. 8 are the same as those of the corresponding rollers 4–7 of FIGS. 1 and 2. The rollers 4–7 of FIG. 8 are carried by a pair of non-illustrated, spaced plates such as the plates 2 of FIGS. 1 and 2. The respective plates constituting part of the rack of FIG. 8 are of one piece, that is, each of the plates supports all of the rollers 4–7.

In addition to the rollers 4–7, a pair of admitting rollers 48, 49 is disposed at the inlet of the rack of FIG. 8. The admitting rollers 48, 49 engage a photosensitive article entering the processing bath and advance it to the nip defined by the rollers 6,7.

The rack of FIG. 8 may be provided with guide means similar to the connecting elements 8 of FIGS. 1 and 2 between the rollers 6,5 and 5,4.

The bottom of the container 1 of FIG. 8 is provided with an outlet 1*c* leading to a system for circulating the processing fluid. The outlet 1*c* communicates with the suction side of a circulating pump 50 which is connected with a three-way valve 51 such as, for instance, a solenoid valve, on its pressure side. The valve 51 has a first position, e.g., when the valve 51 is connected with a voltage source, in which the pump 50 communicates with a spray nozzle 52 located at the discharge side of the admitting rollers 48, 49. The spray nozzle 52 preferably extends across the full width of a photosensitive article to be processed. The valve 51 further has a second position, e.g., when the valve 51 is disconnected from a voltage source, in which the pump 50 communicates with a pair of inlet openings 53 and 54 in a wall of the container 1. The opening 53 is disposed at approximately the level of the bottom of the nip defined by the admitting rollers 48, 49 and is directed towards the space defined immediately below the nip by the lower portions of the rollers 48,49. Similarly, the opening 54 is disposed at approximately the level of the bottom of the nip defined by the rollers 6, 7 and is directed towards the space defined immediately below such nip by the lower portions of the rollers 6, 7. The plate of the rack confronting the wall of the container 1 with the openings 53,54 is provided with two openings which respectively register with the openings 53,54. The axes of the openings 53, 54, as well as those of the openings in the plate, are substantially parallel to the axes of rotation of the rollers 4–7, 48, 49.

A switch 55 is provided to control the valve 51. The switch 55 may, for example, lie in the path of a non-illustrated, light-tight cover for the entire wet processing arrangement. The switch 55 is then open when the cover is open, and closed then the cover is closed.

The operation of the wet processing arrangement of FIG. 8 is as follows:

The rack including the rollers 4–7, 48, 49 is positioned above the container 1 so that the rotational axes of the rollers 4–7, 48, 49 are substantially horizontal and is immersed in the processing bath in this orientation. During immersion, air bubbles are trapped at least below the nip defined by the rollers 48, 49 and that defined by the rollers 6, 7.

The cover of the wet processing arrangement is open when the rack is introduced into the container 1. Before the cover is closed, the circulating pump 50 is started and the processing bath is adjusted preparatory to processing. Adjustment of the processing bath may comprise temperature adjustment thereof. Since the cover is open, the valve 51 has a position in which the pump 50 communicates with the inlet openings 53, 54. Accordingly, currents of processing fluid enter the container 1 through the openings 53,54, and these currents flow into the spaces immediately below the nips defined by the rollers 48, 49 and 6,7 via the respective openings in the neighboring plate of the rack. The currents exiting the openings 53, 54 drive the fluid beneath the nips, together with the air bubbles trapped in such fluid, towards the side of the container 1 opposite that with the openings 53, 54. The side of the container 1 opposite that with the openings 53, 54 is free of flow openings so that, upon reaching the ends of the rollers remote from the openings 53, 54, the flowing fluid can be diverted from the flow path along the nips. The air bubbles then rise and escape.

When processing of photosensitive articles is to begin, the cover of the wet processing arrangement is closed. This causes the switch 55 to close. Closing of the switch 55 results in movement of the valve 51 to the position in which the pump 50 communicates with the spray nozzle 52 so that the latter directs the processing fluid being circulated by the pump 50 onto photosensitive articles entering the processing bath. At this time, the inlet openings 53, 54 are no longer supplied with fluid.

Control means other than a switch 55 activated by the cover of the wet processing arrangement may be provided for the valve 51. By way of example, the wet processing arrangement may include a temperature regulating unit for the processing bath, and this unit may be employed to switch the valve 51 between the different positions thereof.

Normally, when the rack is removed from the bath in order to perform certain operations upon the same, the temperature is no longer at the proper level at the time that the rack is returned to the bath. Thus, there is a certain interval between the time that the rack is reinserted in the bath and the time that the processing arrangement is again in readiness for operation. During this interval, in which the rollers 4–7, 48, 49 are at a standstill, the fluid circulated by the pump 50 may again be directed to the inlet openings 53, 54, e.g., by way of the three-way valve 51, so that trapped air bubbles are removed. The drive or drives for the rollers 4–7, 48, 49 are actuated once the processing arrangement is ready for operation, and switching of the valve 51 to the position in which the spray nozzle 52 is supplied with fluid may take place in response to such actuation.

In principle, it is possible to pump fluid to the inlet openings 53, 54 continually. However, in relatively wide processing arrangements, the expansion of the fluid currents which takes place may endanger the uniformity of processing.

Instead of pushing out air bubbles from beneath the nips defined by the rollers 48, 49 and 6, 7, the direction of flow may be reversed so as to remove the air bubbles by suction.

The openings 53, 54 may be considered to at least partially constitute a means for eliminating air bubbles which tend to form in the region of the nips defined by the roller pairs 48, 49 and 6, 7 during insertion of the rack into the processing bath.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An arrangement for wet processing photosensitive articles, comprising a container for a processing bath; a rack mountable in said container and including a pair of cooperating rollers defining a nip for guiding photosensitive articles; and means for positively eliminating air bubbles which tend to form in the region of said nip upon entry of said rollers into a bath accommodated by said container.

2. The arrangement of claim 1, each of said rollers having an axis of rotation, and said axes defining a plane; and wherein said plane defines an angle of at most 45° with the horizontal when the rack is mounted in said container.

3. The arrangement of claim 1, comprising drive means for said rollers.

4. The arrangement of claim 1, wherein said eliminating means is operative during positioning of said rollers in said container.

5. The arrangement of claim 1, wherein at least one of said rollers is movable away from the other of said rollers to permit the escape of air bubbles trapped in the region of said nip, said eliminating means comprising shifting means for moving said one roller.

6. The arrangement of claim 5, comprising means in said container for directing said rack along a predetermined path during insertion in said container, said shifting means being located in the path of said one roller.

7. The arrangement of claim 1, wherein said rack comprises separable first and second sections, one of said rollers being mounted on one of said sections, and the other of said rollers being mounted on the other of said sections.

8. The arrangement of claim 1, said nip having a lower portion which is arranged to occupy a predetermined location in said container; and further comprising means for circulating the processing bath, said eliminating means including an opening in said container at the level of said predetermined location, and said opening being arranged to communicate with said circulating means and facing said predetermined location.

9. The arrangement of claim 8, said opening having an axis, and each of said rollers having an axis of rotation; and wherein the axis of said opening is at least approximately parallel to said axes of rotation.

10. The arrangement of claim 8, wherein said opening constitutes an inlet of said circulating means.

11. The arrangement of claim 8, wherein said opening constitutes an outlet of said circulating means.

12. The arrangement of claim 8, wherein said circulating means comprises a pump, and control means for connecting said opening with and disconnecting said opening from said pump.

13. The arrangement of claim 12, wherein said control means is designed to connect said opening with said pump during insertion of said rack into said container.

14. The arrangement of claim 12, wherein said control means is designed to connect said opening with said pump during adjustment of the processing bath preparatory to processing.

15. An arrangement for wet processing photosensitive articles, comprising a container for a processing bath; a rack mountable in said container and including a pair of cooperating rollers defining a nip for guiding photosensitive articles; drive means for said rollers; and means for eliminating air bubbles which tend to form in the region of said nip upon entry of said rollers into a bath accommodated by said container, said eliminating means being operative during positioning of said rollers in said container and being rendered inoperative in response to activation of said drive means.

16. An arrangement for wet processing photosensitive articles, comprising a container for a processing bath; a rack mountable in said container and including a pair of cooperating rollers defining a nip for guiding photosensitive articles; drive means for said rollers; and means for eliminating air bubbles which tend to form in the region of said nip upon entry of said rollers into a bath accommodated by said container, said eliminating means being operative prior to, and being rendered inoperative in response to, activation of said drive means.

17. An arrangement for wet processing photosensitive articles, comprising a container for a processing bath; a rack mountable in said container and including a pair of cooperating rollers defining a nip for guiding photosensitive articles; and means for eliminating air bubbles which tend to form in the region of said nip entry of said rollers into a bath accommodated by said container, said eliminating means comprising guide means which requires said rollers to pivot in such a manner during positioning of the latter in said container that air has a chance to escape from the region of said nip.

18. The arrangement of claim 17, each of said rollers having an axis of rotation; and wherein said guide means requires pivoting about an axis substantially parallel to said axes of rotation.

19. The arrangement of claim 18, said axes of rotation defining a plane; and wherein said guide means is arranged so that pivoting of said rollers must be initiated from a position in which said plane defines an angle of at least 60° with the horizontal.

20. The arrangement of claim 10, wherein said guide means comprises bearing means on said container designed to rotatably support a portion of said rack.

21. The arrangement of claim 20, wherein said portion of said rack comprises a pivot which substantially parallels said axes of rotation.

22. The arrangement of claim 17, each of said rollers having an axis of rotation; and wherein said guide means requires pivoting in a plane which is substantially perpendicular to the horizontal and passes through at least one of said axes.

23. The arrangement of claim 22, wherein said guide means comprises retaining means in said container designed to receive a portion of said rack, said container and said rack being constructed in such a manner that said portion is insertable in said retaining means only by inclining said axes to the horizontal.

24. The arrangement of claim 23, wherein said retaining means comprises a recess in said container.

25. The arrangement of claim 23, wherein said retaining means comprises a clamping device.

26. An arrangement for wet processing photosensitive articles, comprising a container for a processing bath; a rack mountable in said container and including a pair of cooperating rollers defining a nip for guiding photosensitive articles, at least one of said rollers being movable away from the other of said rollers to permit the escape of air bubbles trapped in the region of said nip; drive means for said rollers; and means for eliminating air bubbles which tend to form in the region of said nip upon entry of said rollers into a bath accommodated by said container, said eliminating means comprising shifting means for moving said one roller, and said shifting means including a manually operable lever.

27. The arrangement of claim 26, wherein said lever is operable during insertion of said rack into said container.

28. An arrangement for wet processing photosensitive articles, comprising a container for a processing bath; a rack mountable in said container and including a pair of cooperating rollers defining a nip for guiding photosensitive articles, at least one of said rollers being movable away from the other of said rollers to permit the escape of air bubbles trapped in the region of said nip; means in said container for directing said rack along a predetermined path during insertion in said container; and means for eliminating air bubbles which tend to form in the region of said nip upon entry of said rollers into a bath accommodated by said container, said eliminating means comprising shifting means for moving said one roller, and said shifting means being located in the path of said one roller and including a cam.

29. An arrangement for wet processing photosensitive articles, comprising a containing for a processing bath; a rack mountable in said container and including a pair of cooperating rollers defining a nip for guiding photosensitive articles, at least one of said rollers being movable away from the other of said rollers to permit the escape of air bubbles trapped in the region of said nip, and said one roller being arranged to occupy a predetermined location in said container; means in said container for directing said rack along a predetermined path during insertion in said container; and means for eliminating air bubbles which tend to form in the region of said nip upon entry of said rollers into a bath accommodated by said container, said eliminating means comprising shifting means for moving said one roller, and said shifting means being located in the path of said one roller and being designed to hold said one roller away from said other roller along a segment of the path of said one roller terminating close to said predetermined location.

30. An arrangement for wet processing photosensitive articles, comprising a container for a processing bath; a rack mountable in said container and including a pair of cooperating rollers defining a nip for guiding photosensitive articles, said rack comprising separable first and second sections, and one of said rollers being mounted on one of said sections, the other of said rollers being mounted on the other of said sections; and means for eliminating air bubbles which tend to form in the region of said nip upon entry of said rollers into a bath accommodated by said container, said eliminating means comprising means for preventing insertion of said sections in said container simultaneously.

31. The arrangement of claim 30, wherein said preventing means is provided on said container.

32. The arrangement of claim 31, wherein said preventing means comprises a protuberance.

* * * * *